United States Patent [19]

Geraci

[11] 4,192,032

[45] Mar. 11, 1980

[54] CONTOUR SHEET FOR A CONVERTIBLE SOFA BED

[76] Inventor: Fred Geraci, 4300 NW. 8th St., Plantation, Fla. 32504

[21] Appl. No.: 890,600

[22] Filed: Mar. 20, 1978

[51] Int. Cl.[2] ..... A47G 9/02

[52] U.S. Cl. ..... 5/497; 5/465; 5/499

[58] Field of Search ..... 5/13, 91, 343 C, 343 R, 5/352, 357

[56] References Cited

U.S. PATENT DOCUMENTS

| | | | |
|---|---|---|---|
| 1,312,110 | 8/1919 | Duncan | 5/465 |
| 3,188,660 | 6/1965 | Guttman | 5/465 |
| 3,583,009 | 6/1971 | Smith | 5/499 |

*Primary Examiner*—Casmir A. Nunberg
*Attorney, Agent, or Firm*—Malin & Haley

[57] ABSTRACT

A contour bedding sheet for use with a convertible sofa bed mattress that prevents tearing, ripping or engagement of the sheet with the sofa bed frame members. The sheet includes a fabric area for covering the top of the mattress, first, second, and third side overlap panels which overlap the sides of the mattress on each side, the panels being spaced apart to allow for the folding in the mattress, the panel ends being joined by elastic members disposed at particular locations to insure tautness of the sheet relative to the mattress surface regardless of the angular position of sections of the mattress relative to each other.

1 Claim, 3 Drawing Figures

CONTOUR SHEET FOR A CONVERTIBLE SOFA BED

BACKGROUND OF THE INVENTION

This invention relates generally to a contour sheet that is used to cover a mattress employed with a conventional sofa bed or "hideaway bed", in which the mattress is subjected to one or more folds when in the stowed or sofa position.

The use of convertible sofa beds or hideaway beds is well known. In the past, providing mattress or sheet covers which remain on the mattress even when stowed has presented a problem in that often times loose fitting sheets become engaged or tangled during the stowage or removal of the mattress with the rigid frame members causing a sheet or mattress cover to be torn or ripped. The alternative was to remove the sheet each time the mattress was stowed.

The present invention eliminates the engagement of the sheet with the frame members by insuring that the fabric sheet member remains relatively taut relative to the mattress surface, preventing displacement of the sheet throughout.

BRIEF DESCRIPTION OF THE INVENTION

A contour bedding sheet for use with a convertible sofa bed mattress that allows the sheet to remain stretched and taut relative to the mattress surface regardless of the disposition of the mattress, i.e. folded, partially folded or unfolded (when used as a bed). The tautness of the sheet prevents entanglement of the sheet with the sofa bed frame members such that ripping and tearing of the sheet cannot occur.

The sheet is constructed of a single sheet of fabric having elastic band members disposed in critical areas in conjunction with particular fabric panels and panel cut out areas.

The sheet is comprised of a substantially uniform rectangular fabric area that covers the top surface of the mattress, a pair of end panels that overlap the ends of the mattress and a portion of the bottom of the mattress, and a plurality of spaced side panels that overlap the sides and a portion of the mattress bottom near the mattress sides. The side and end panels are joined by elastic band members at the four corners of the mattress.

The sheet sides are identical in construction, as are the sheet ends. Each side of the sheet includes two substantial cut-out areas (viewed longitudinally) essentially located where the mattress folds in the stowed or sofa position. In most conventional sofa beds, the mattress folds 180 degrees on itself about one-third of the longitudinal distance from the foot of the bed and folds about 90 degrees about two-thirds from the foot of the bed. The first side panel is disposed from the end used at the foot of the bed to a location just before the mattress 180 degree fold. An intermediate side panel extends from just beyond the mattress 180 degree fold to a position just short of the mattress 90 degree fold. The third side panel extends from the head of the mattress to a position just before the 90 degree mattress fold. The panels are joined together by elastic bands. A pair of fabric strips are positioned in the space between the first and intermediate side panels at the mattress 180 degree fold.

It is an object of this invention to provide a contour bedding sheet for use as a mattress covering for a mattress utilized in a convertible sofa bed or the like.

It is another object of this invention to provide a contoured bedding sheet for convertible sofa bed mattress which insures that the sheet remain taut or stretched relative to the mattress surface regardless of the positioning of the mattress.

And yet, still another object of the invention is to provide a bedding sheet for a mattress that insures and prevents ripping or tearing or engagement of the mattress cover with the frame collapsible members that support the mattress to prevent ripping or tearing of the sheet.

In accordance with these and other objects which will be apparent hereinafter, the instant invention will now be described with particular reference to the accompanying drawings.

PREFERRED EMBODIMENT OF THE INVENTION

Figure 1:
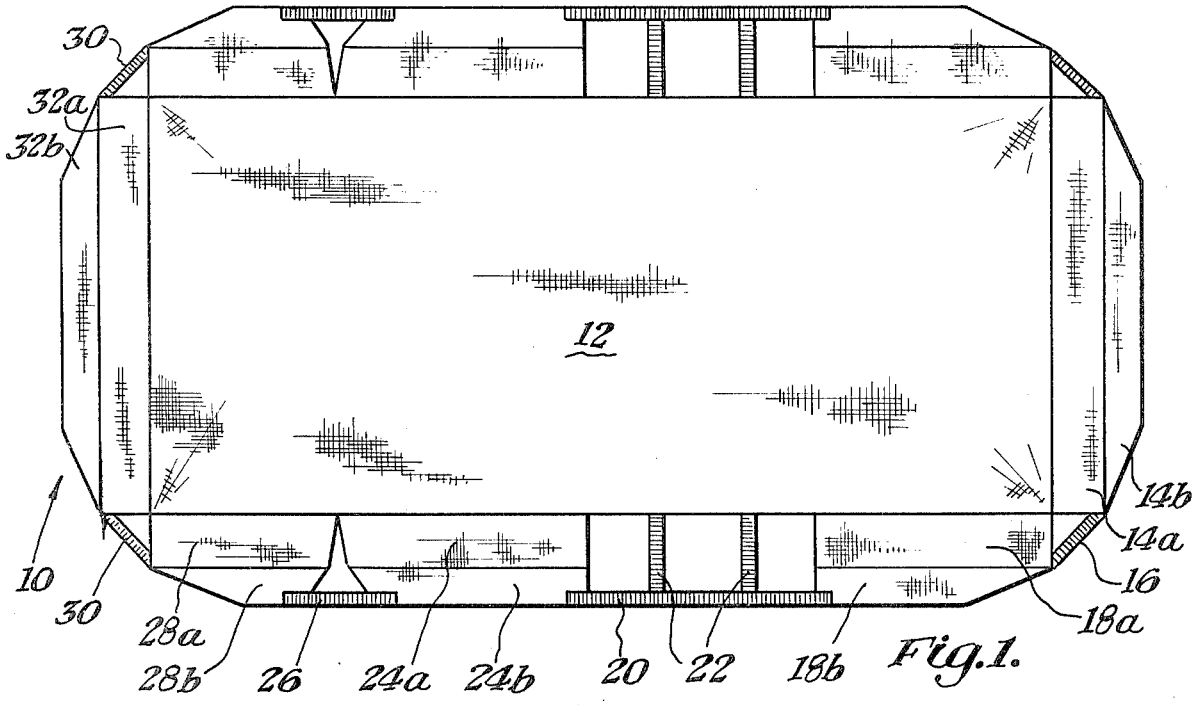
FIG. 1 shows a top plan view of a bedding sheet in accordance with the instant invention.

Referring now to the drawings and specifically FIG. 1, the instant invention is shown generally at 10 comprised of a uniform fabric sheet 12 that includes a substantially rectangular surface area that covers the top of a conventional mattress as found in a sofa bed. Uniformly constructed with the fabric sheet 12 is a panel 14 which includes overlapped panel portions **14*a* and 14*b* which cover the foot of the mattress, panels 32*a* and 32*b* which cover the head of the mattress and overlap the edges of the mattress, and along one side, side panels 18, 24, and 28**. The opposite side panel is identical in construction such that only one side of the sheet will be discussed.

The foot panel overlaps the foot end of the mattress while panel **14*b*, which is somewhat trapezoidal in shape, projects beneath the bottom edge of the mattress along the foot end. The foot panel 14*a* is resiliently coupled to side panel 18*a* by an elastic band 16. Side panels 18*a* and 18*b* overlap the side and bottom edge portions of the mattress and are sized in length to proceed from the foot of the mattress to a position approximately one-third the longitudinal distance of the mattress to the area just preceeding the major fold, where the mattress in the stored position is folded back upon itself, approximately at 180 degrees. The intermediate panel 24*a* and 24*b* likewise overlap the side and the bottom portion of the mattress and are spaced from panels 18*a* and 18*b* a sufficient distance to compensate for the mattress fold. Supporting strips 22 are disposed between the panel 18*a* and 18*b* and the intermediary panels 24*a* and 24*b* and are coupled to an elastic band 20** that joins the foot panels with the intermediate panels.

At the head of the mattress is a head panel 32 having an overlapped portion **32*a* that covers the end side face of the head of the mattress and a somewhat trapezoidally shaped panel that fits beneath the bottom side, flushly with the surface of the mattress. The side head panel 28 is coupled to the end head panel 32 by an elastic band 30. Each of the corners of the mattress cover include elastic bands such as 30 and 16** at all four corners to provide a taut fit between the end panels and the side panel members.

Side panel 28, which is disposed near the head of the bed, includes a mattress overlap portion 28*a* and portion 28*b* which fits beneath the mattress and is spaced from intermediate panel 24 a sufficient distance to allow approximately a 90 degree fold in the mattress. The peripheral edges of the intermediate panel 24 and the side panel 28 are joined by an elastic band 26. Since on a conventional sofa bed, the mattress near the head of the bed is folded to only a 90 degree position, the spacing between the side panel 28 and the intermediate panel is smaller than the spacing between the intermediate panel and the foot side panel 18 since the mattress does not have to fold as much.

Figure 3:
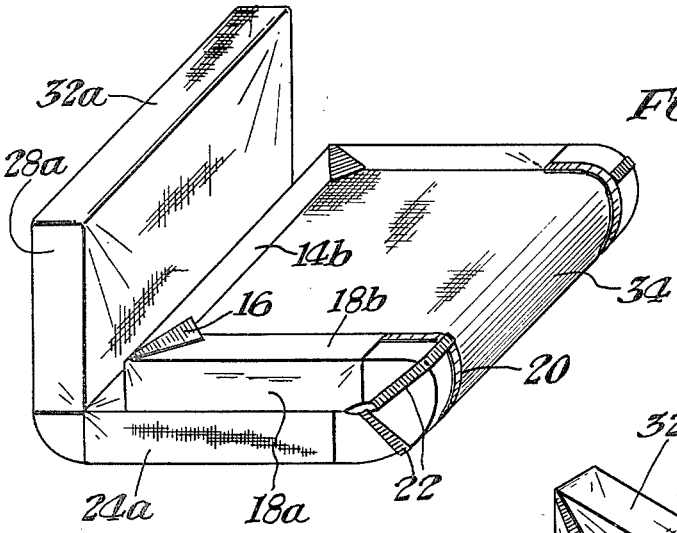
FIG. 3 shows a sofa bed mattress in perspective with the instant invention disposed thereon with the mattress being in the folded position as it would be stowed in a convertible sofa bed.
Figure 2:
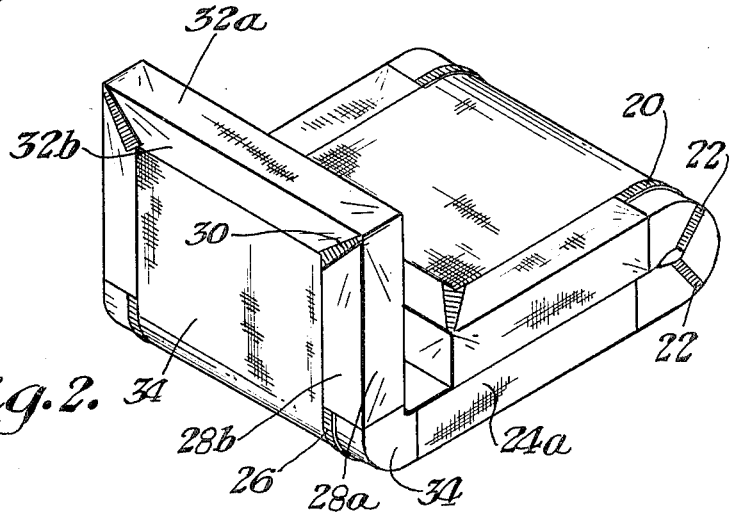
FIG. 2 shows a perspective view showing the foot of the mattress with the instant invention disposed thereon in a folded position without the sofa or frame mechanism shown.

FIGS. 2 and 3 show the mattress sheet disposed on one type of sofa bed mattress, in the final folded position.

As shown, mattress 34 has a first folded portion (which represents the head of the mattress) at approximately 90 degrees and the second folded portion which is folded back approximately 180 degrees. As shown in FIGS. 2 and 3, the mattress corners include elasticized portions 16 and 30 which tension the four corners and contour sheet panels therebetween. Additionally, the elastic band 20 and elastic band 26 provide tension between the end side panels and the intermediary panel 24 in the folded position. The strips 22 act to hold the sheet in position while preventing and looseness across the top of the sheet near the fold.

The spacing between the foot of the side panel and the intermediary panel is sufficient to allow the mattress fold of approximately 180 degrees such that the elastic band 20 will be stretched while the top of the mattress is firmly held by the side strips 22. Thus, in the unfolded position, the side strips will firmly hold the mattress in position while compensating for the overlap of the mattress as shown in FIG. 2.

The spaced panels, as shown, could be adapted to a mattress that folds along its longitudinal axis by providing similar spacing between the overlap panels along the edges to accommodate a particular type of sofa bed and a particular type of mattress fold. Spaced portions of the panels will be provided with elasticized bands to insure that the mattress cover remains taut regardless of the disposition of the mattress itself.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A bedding sheet cover for a mattress employed in a sofa bed in which the mattress includes folded portions to insure that the mattress cover remains stretched to prevent entanglement with frame members of the sofa bed comprising:

a fabric sheet having a portion sized to cover the top of the mattress, said fabric sheet including first and second end panels which overlap the mattress at each end, said first and second end panels including a bottom overlapped portion for overlapping the bottom of the mattress at each end, and a plurality of side panels, said side panels being spaced apart sufficiently to accommodate for a particular fold of the mattress in the stowed position, said side panels joined by elasticized bands.

* * * * *